United States Patent [19]

Osinga

[11] Patent Number: 4,536,729

[45] Date of Patent: Aug. 20, 1985

[54] ELECTROMAGNETIC DEFLECTION UNIT AND PICTURE TUBE PROVIDED WITH SUCH A UNIT

[75] Inventor: Halbe Osinga, Eindhoven, Netherlands

[73] Assignee: U.S. Philips Corporation, New York, N.Y.

[21] Appl. No.: 651,750

[22] Filed: Sep. 18, 1984

[30] Foreign Application Priority Data

Sep. 23, 1983 [NL] Netherlands ..... 8303267

[51] Int. Cl.[3] ..... H01F 7/00

[52] U.S. Cl. ..... 335/210; 335/213

[58] Field of Search ..... 335/210, 212, 213; 313/421, 426, 429, 430, 431

[56] References Cited

U.S. PATENT DOCUMENTS 3,637,930 1/1972 Meier ..... 335/210

3,764,740 10/1973 Deal ..... 335/210

FOREIGN PATENT DOCUMENTS 626453 9/1978 U.S.S.R. ..... 335/210

*Primary Examiner*—George Harris

*Attorney, Agent, or Firm*—Thomas A. Briody; William J. Streeter

[57] ABSTRACT

An electromagnetic deflection unit has a conical coil holder of synthetic material which is provided at its wide end a flange. The coil holder carried deflection coils and a conical ring of soft magnetic material. The ring is enclosed at both its ends in a moulded-on ring of synthetic material provided with laterally extending projections. On these projections the step of securing the conical ring to the flange of the coil holder in aligned position with respect to the coils is carried out.

11 Claims, 3 Drawing Figures

ELECTROMAGNETIC DEFLECTION UNIT AND PICTURE TUBE PROVIDED WITH SUCH A UNIT

BACKGROUND OF THE INVENTION

1. Field of the Invention

The invention relates to an electromagnetic deflection unit for a picture tube comprising deflection coils which are carried by a conical coil holder of synthetic material, and a conical ring of soft magnetic material cooperating with the coils, the coil holder having a flange at its wide end and the conical ring being secured at its wide end to the flange of the coil holder. The invention further relates to a picture tube provided with such a deflection unit.

2. Description of the Prior Art

Such a deflection unit is known from "Funkschau" 25, 1242–6 (1975).

For a correct operation of the deflection unit, it is necessary that the conical ring of soft magnetic material, the so-called yoke ring, is aligned with respect to the coils in directions at right angles to the longitudinal direction of the conical coil holder. In the known deflection unit, the conical ring is adhered in the correct position to the flange of the coil holder by means of a comparatively rapidly curing glue and is then fixed in that position by means of a curing mass of synthetic material. For the known deflection unit, not only a large quantity of mass of synthetic material, but also a long period of time is required for causing this mass to be cured. These factors have a great influence on the cost of the unit.

SUMMARY OF THE INVENTION

The invention has for its object to provide a deflection unit of a construction which permits rapid securing of the conical ring to the flange of the coil holder.

According to the invention, this object is achieved in an electromagnetic deflection unit of the kind mentioned in the opening paragraph in that the conical ring is enclosed at its wide end in a moulded-on ring of synthetic material, which has laterally extending projections which are distributed along its circumference, and in that on these projections the conical ring is secured to the flange of the coil holder.

The projections on the ring of synthetic material provide the yoke ring members which can be in engagement with securing means of various kinds without the risk of the yoke ring being damaged. The size, the number and the location of these projections are chosen in accordance with the size and the weight of the yoke ring so that they provide a sufficient engagement for the securing means to guarantee a stable position of the yoke ring. In general, three or four projections regularly distributed along the circumference will be sufficient for this purpose.

The flange of the coil holder may have seats for the various projections. The seats may be depressed in the flange or may be limited by a continuous raised portion. Although during the alignment the yoke ring must have a lateral clearance with respect to the coil holder, the seats need have only a slightly larger extent than the projections. A possibility of rapidly securing the yoke ring to the flange of the coil holder, which is due to the limited space in the seat, is to use a quick-curing glue, for example a two-component glue, which is mixed immediately before being applied.

Another possibility is to use mechanical means, which surround the projections with clamping fit. In this case, use may be made, for example, of wedges which keep the projections pressed against the seats of the flange. The cooperating surfaces of the projections and the seats may then be roughened. Alternatively, it is possible to utilize a plastic deformation of the seat for securing the projections.

However, a very attractive alternative is to secure the yoke ring to the flange of the coil holder by fusing the projections with the flange. In this construction, no auxiliary materials and only a few means on the coil holder are required. The securing operation can be effected very rapidly by means of one or more sonotrodes, ultrasonically vibrating pins, so that the time of residence of a deflection unit on the apparatus on which the alignment of the yoke ring takes place may be very short.

In a preferred embodiment, the projections are elastically deformed in the longitudinal direction of the yoke ring at least in the proximity of the points at which they are secured to the flange of the coil holder respectively to the respective seats, so that the yoke ring is held in a position in which it is drawn towards the flange of the coil holder. In a particularly favourable variation, the flange has reference points on which the yoke ring with the ring of synthetic material bears.

It should be noted that numerous deflection units are known in which a curing mass of synthetic material is moulded or injection-moulded between the yoke ring and the deflection coils in order to fix the yoke ring (for example, Dutch Patent Application 7807176). The said deflection units have the same disadvantages as the unit described in the opening paragraph.

It should further be noted that a yoke ring with a ring of synthetic material moulded-on at its both ends is known from Dutch Patent Application 8203133 (PHN 10416). However, this moulded-on ring has no projections on which the operation of securing the ring can be carried out. On the contrary, the ring is profiled in order to receive segments of deflection coils.

Embodiments of the deflection unit and the picture tube according to the invention are shown in the drawings.

DESCRIPTION OF THE PREFERRED EMBODIMENTS

Figure 1:
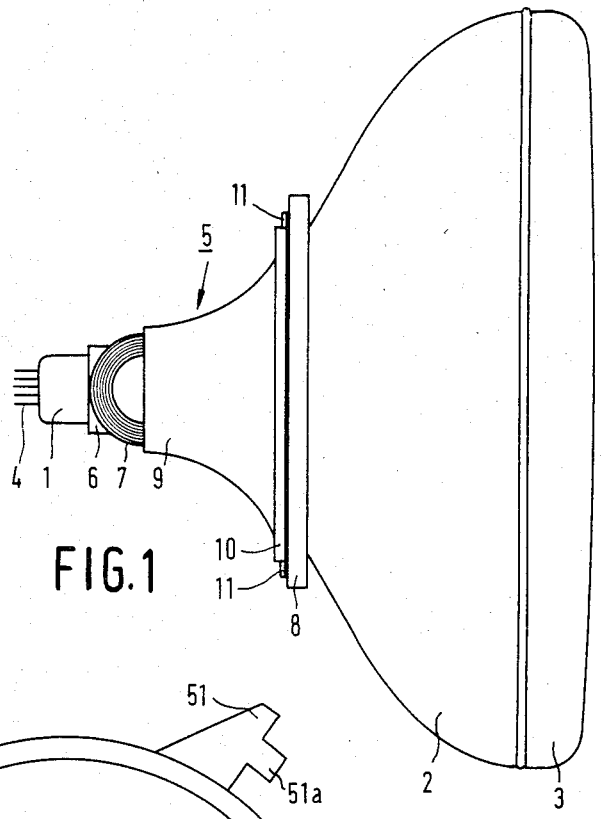
FIG. 1 is a side elevation of a picture tube according to the invention.

The picture tube shown in FIG. 1 has a neck 1, a cone 2 and a display screen 3. Connecting pins 4 are passed from the neck 1 to the outside. A deflection unit 5 is arranged to surround the neck 1 and to engage the cone 2. The deflection unit has a conical coil holder 6 of synthetic material, for example, a polystyrene/polyphenylene oxide, which carries deflection coils of the saddle type, one of which (7) is visible. The coil holder 6 has a flange 8 at its wide end. A conical ring 9 of soft magnetic material, for example, nickel-zinc-ferrite or manganese-zinc-ferrite, is arranged to surround the coils and cooperates with them. The conical ring 9 is enclosed at its wide end in a moulded-on ring 10 of synthetic material, for example, of polystyrene/-polyphenylene oxide. The ring 10 of synthetic material has laterally extending projections 11, which are distributed along its circumference and on which the step of securing the conical ring 9 to the flange 8 of the coil holder 6 is carried out.

Figure 2:
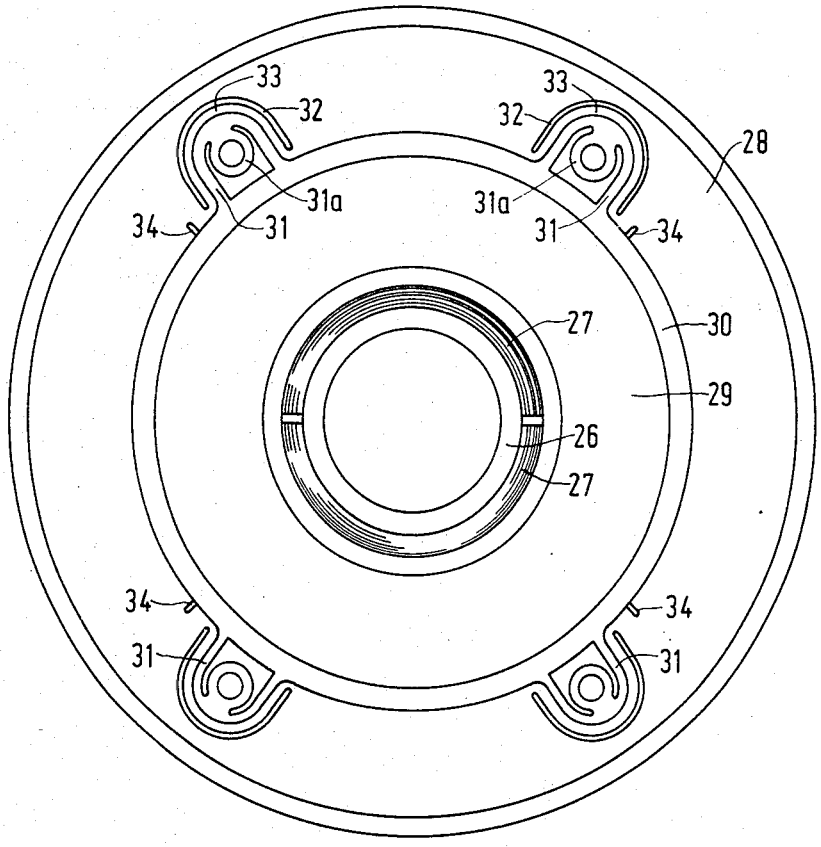
FIG. 2 shows a deflection unit according to the invention, viewed from the narrow end of the coil holder.

In FIG. 2, parts corresponding to parts in FIG. 1 each have a reference numeral which is 20 higher. In this Figure, both coils 27 of one of the coil pairs are visible. The moulded-on ring 30 of synthetic material integral with the yoke ring 29 has four projections 31 each having an individual seat 33 on the flange 28 of the coil holder 26. In the embodiment shown, the seats 33 are limited by continuous raised portions 32 on the flange 28. As a result, spaces are formed which on the one hand are sufficiently large to permit a lateral displacement of the projections upon the alignment of the yoke ring 29 with respect to the coils (inter alia the coils 27) and on the other hand are sufficiently small to provide them with a quick-curing glue for securing the yoke ring 29 to the flange 28 on the projections 31.

In the embodiment shown the projections 31 are provided with incisions, as a result of which eyelets 31*a* are formed which are integral with the respective projections 31 at the end remote from the ring 30. The projections 31 are secured to the seats at the area of the eyelets 31*a* by fusing the material of the eyelets 31*a* and that of the seats 33 by means of sonotrodes.

The flange 28 has reference points 34 in the form of projections on which bears the ring 30 of synthetic material of the yoke ring 29. In this embodiment, the projections 31 are elastically deformed at least in the proximity of their eyelets 31*a* due to the presence of the cams 34, as a result of which the yoke ring is kept drawn towards the flange 28 in its longitudinal direction by the projections 31.

Figure 3:
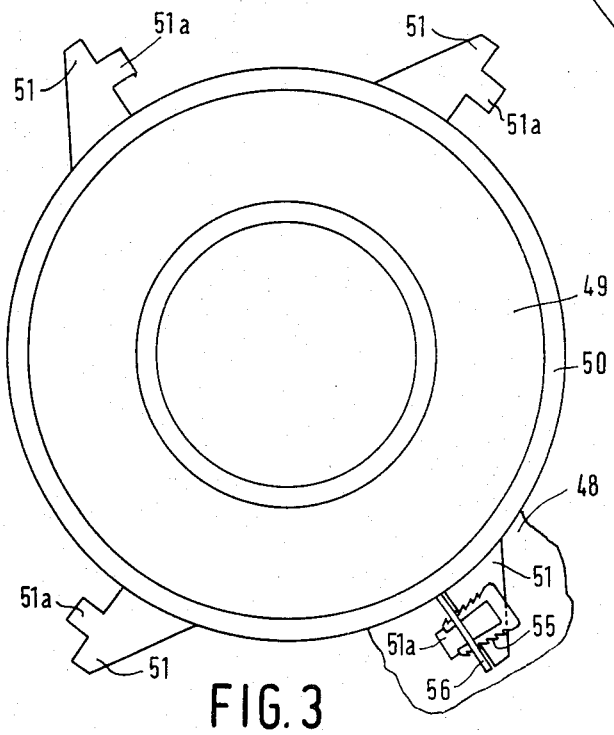
FIG. 3 shows another embodiment of a yoke ring, viewed from the narrow end, on a coil holder broken away for the major part.

In FIG. 3, corresponding parts each have a reference numeral which is 20 higher than in FIG. 2. The projections 51 can be mechanically secured to the flange 48 of a coil holder partially shown at the right below. In the Figure, the flange 48 has a yoke 56 under which is located a tongue 51*a* of the projection 51, displaceable in two orthogonal directions along the surface of the flange 48. Under the yoke 56 is also situated a wedge 55 in the form of a U-shaped body, the limbs of which are toothed on the outer side and increase in thickness towards the base of the U. After alignment of the yoke ring 49, the wedge 55 has been pushed further under the yoke 56 so that the projection 51 is secured to the flange 48. The cooperating surfaces of the tongue 51*a* and the flange 48 are roughened.

What is claimed is:

1. In an electromagnetic deflection unit for a picture tube, said deflection unit having deflection coils which are carried by a conical coil holder of synthetic material, a conical ring of soft magnetic material cooperating with the coils, and the coil holder having a flange at its wide end and the conical ring being secured at its wide end to the flange of the coil holder, the improvement wherein the conical ring is enclosed at its wide end in a moulded-on ring of synthetic material which has laterally extending projections which are distributed along its circumference, and in that on these projections the conical ring is secured to the flange of the coil holder.

2. An electromagnetic deflection unit as claimed in claim 1, wherein the flange of the coil holder has seats for the respective projections.

3. An electromagnetic deflection unit as claimed in claim 2, wherein the projections are secured to the flange of the coil holder by mechanical means.

4. An electromagnetic deflection unit as claimed in claim 3, wherein the projections are kept pressed against the seats by means of wedges.

5. An electromagnetic deflection unit as claimed in claim 1 wherein the projections are fused with the flange of the coil holder.

6. An electromagnetic deflection unit as claimed in claim 1, wherein the projections are elastically deformed in the longitudinal direction of the ring of soft magnetic material in the proximity of the points at which they are secured to the flange of the coil holder.

7. An electromagnetic deflection unit as claimed in claim 6, wherein the flange of the coil holder has reference points on which bears the ring of soft magnetic material with the ring of synthetic material.

8. An electromagnetic deflection unit as claimed in claim 2 wherein the projections are fused with the flange of the coil holder.

9. An electromagnetic deflection unit as claimed in claim 2 wherein the projections are elastically deformed in the longitudinal direction of the ring of soft magnetic material in the proximity of the points at which they are secured to the flange of the coil former.

10. An electromagnetic deflection unit as claimed in claim 5 wherein the projections are elastically deformed in the longitudinal direction of the ring of soft magnetic material in the proximity of the points at which they are secured to the flange of the coil former.

11. In combination, a picture tube and an electromagnetic deflection unit therefor, said deflection unit having deflection coils which are carried by a conical coil holder of synthetic material, a conical ring of soft magnetic material cooperating with the coils, and the coil holder having a flange at its wide end and the conical ring being secured at its wide end to the flange of the coil holder, the improvement wherein the conical ring is enclosed at its wide end in a moulded-on ring of synthetic material which has laterally extending projections which are distributed along its circumference, and in that on these projections the conical ring is secured to the flange of the coil holder.

* * * * *